US007170228B2

(12) United States Patent
Hecker et al.

(10) Patent No.: US 7,170,228 B2
(45) Date of Patent: Jan. 30, 2007

(54) CERAMIC ARC TUBE HAVING AN INTEGRAL SUSCEPTOR

(75) Inventors: Arlene Hecker, Beverly, MA (US); Gregory Zaslvasky, Marblehead, MA (US); Ernest Davey, Jr., Hampton Falls, NH (US); Dana Caldwell, Middleton, MA (US)

(73) Assignee: Osram Sylvania Inc., Danvers, MA (US)

( * ) Notice: Subject to any disclaimer, the term of this patent is extended or adjusted under 35 U.S.C. 154(b) by 289 days.

(21) Appl. No.: 10/881,197

(22) Filed: Jun. 30, 2004

(65) Prior Publication Data

US 2006/0001379 A1 Jan. 5, 2006

(51) Int. Cl.
*H01J 61/35* (2006.01)

(52) U.S. Cl. ..... 313/623; 313/594; 313/607

(58) Field of Classification Search ..... 313/635, 313/607, 594, 634, 234
See application file for complete search history.

(56) References Cited

U.S. PATENT DOCUMENTS

| | | | | |
|---|---|---|---|---|
| 5,424,609 | A | 6/1995 | Geven et al. | 313/623 |
| 5,541,480 | A * | 7/1996 | Renardus et al. | 313/635 |
| 5,973,453 | A | 10/1999 | Van Vliet et al. | 313/623 |
| 6,172,462 | B1 * | 1/2001 | Gibson et al. | 313/594 |
| 6,354,901 | B1 | 3/2002 | Bundo et al. | 445/26 |
| 6,465,940 | B1 | 10/2002 | Ikeuchi et al. | 313/283 |
| 6,525,476 | B1 | 2/2003 | Geijtenbeek et al. | 313/640 |
| 6,620,272 | B2 | 9/2003 | Zaslavsky et al. | 156/73.5 |
| 2002/0117965 | A1 | 8/2002 | Kotter et al. | 313/573 |

* cited by examiner

*Primary Examiner*—Joseph Williams
(74) *Attorney, Agent, or Firm*—Robert F. Clark

(57) ABSTRACT

A ceramic arc tube having an integral susceptor for RF inductive sealing is described. The integral susceptor in the form of an electrically conductive coating is applied directly to the surface of the arc tube in the seal region. This enables RF heating which is sufficient to melt a frit material and hermetically seal the arc tube. The integral susceptor further provides for a more controlled placement of the seal.

20 Claims, 3 Drawing Sheets

CERAMIC ARC TUBE HAVING AN INTEGRAL SUSCEPTOR

TECHNICAL FIELD

This invention relates to ceramic arc tubes having frit seals and methods of forming said frit seals. More particularly, this invention relates to the radio frequency (RF) sealing of ceramic arc tubes.

BACKGROUND ART

High-intensity discharge (HID) lamps containing ceramic arc tubes are well known. Such lamps include high pressure sodium lamps and metal halide lamps which contain translucent polycrystalline (PCA) arc tubes. In the case of metal halide lamps, the arc tubes have opposed capillary tubes extending outwardly from an axially symmetric body. Each capillary tube contains an electrode assembly which provides the electrical energy needed to strike the arc discharge inside the discharge vessel. The end region of each capillary tube is sealed hermetically to the electrode assembly with a frit material. Examples of such arc tubes are described in U.S. Pat. Nos. 5,973,453 and 5,424,609, and European Patent Nos. 0 971 043 A2 and 0 954 007.

One state-of-the-art method uses radio frequency (RF) heating to form the hermetic seals in the capillary tubes. U.S. Patent Publication No. 2002/0117965, which is incorporated herein by reference, describes a method for sealing a ceramic arc tube by RF induction heating. The RF sealing apparatus comprises a resealable pressure chamber with an RF induction heater mounted at one end. The RF induction heater is comprised of an RF power supply, an RF induction coil located external to the pressure chamber, and an RF susceptor located within the chamber. The end of the arc tube to be sealed is held within the RF susceptor, preferably a hollow graphite cylinder. During sealing, the RF susceptor absorbs energy from the RF induction coil causing the susceptor to heat up. The thermal radiation emitted by the hot susceptor in turn causes a ring of frit material mounted on the end of the capillary to melt and the molten frit flows into the open end of the capillary tube and down along the electrode assembly. When the RF power is removed, the frit solidifies forming a hermetic seal.

While this method is effective, when the susceptor is part of the apparatus, a series of susceptors must be designed, maintained, and installed to match the variety of arc tube sizes to be sealed. Graphite is often used as a susceptor material because it is machinable, electrically conductive while highly resistive, and can withstand high temperatures (~3000° C.) in inert atmospheres. However, graphite susceptors have a limited lifetime, are somewhat fragile, and their electrical properties can vary depending on the manufacturing method.

SUMMARY OF THE INVENTION

We have discovered that an RF susceptor may be formed as an integral part of the ceramic arc tube instead of being part of the sealing apparatus. According to a preferred method of this invention, the integral susceptor is formed from a conductive coating that is applied directly to the exterior surface of the ceramic arc tube in a seal region. The term "seal region" as used herein generally refers to any region of the arc tube where a seal is formed, or components are joined, using at least a partially molten material. This includes regions where ceramic components are joined to each other or to other metal or cermet components as well as regions where openings in the ceramic arc tube are sealed against atmospheric intrusion and/or for containment purposes. Such latter seals are usually desired to be hermetic, however, this invention is not limited to the formation of hermetic seals.

Preferably, the susceptor material should have a coefficient of thermal expansion similar to that of the arc tube material so that it remains adhered to the arc tube over the life of the lamp. The susceptor material should also be able to withstand operation at high temperatures (~1900° C.) in inert atmospheres and couple well with the applied RF energy from the RF induction coil. In a preferred embodiment, the integral susceptor enables RF heating that is sufficient to melt a frit material and hermetically seal an electrode assembly to the arc tube.

The integral susceptor of this invention eliminates the need for an RF susceptor in the sealing furnace since the susceptor is already part of the arc tube to be sealed. As a result, the RF sealing apparatus can be simplified so that there is less labor required to change between various arc tube types. Since the susceptor may be applied by a conventional printing technique, it is easy to adapt the integral susceptor to numerous arc tube types. Moreover, the structure of the susceptor can be altered to provide better coupling to the RF inductor and/or to provide a different heating rate. This can reduce the RF power and time required for sealing. In particular, the susceptor may be formed as a solid band or a coil around the seal region. It should also be possible to reduce the overall length of the arc tube because there is less heating of the entire arc tube during sealing. Perhaps more important, it has been found that the integral susceptor can provide for a more accurate control of the frit seal length thereby minimizing the penetration of the frit into the arc tube beyond the predetermined seal region.

DETAILED DESCRIPTION OF THE INVENTION

Figure 1:
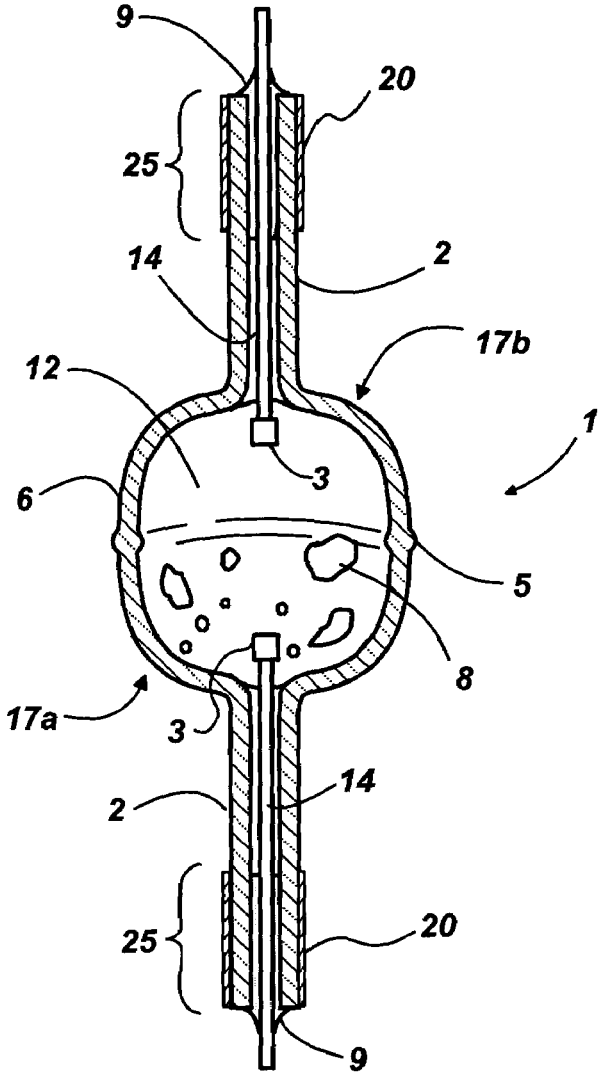
FIG. 1 is a cross-sectional illustration of a sealed ceramic arc tube having integral susceptors on the capillary tubes according to this invention.

For a better understanding of the present invention, together with other and further objects, advantages and capabilities thereof, reference is made to the following disclosure and appended claims taken in conjunction with the above-described drawings.

In a preferred embodiment, standard ceramic fabrication techniques, e.g., injection molding, isopressing, or extrusion of ceramic powders, are first used to form the arc tube or arc tube parts. The green part or parts are then prefired in air to remove the binder material and impart a higher degree of mechanical stability. A coating of the conductive material which forms the integral susceptor is then applied directly to the porous arc tube by one of a number of conventional coating techniques. These include aerosol spraying, dip coating, or applying the coating as an ink with a pen or other ink dispensing means. In the case of aerosol spraying, a conductive powder is combined with an alcohol/acetone/cellulose-based carrier and sprayed onto unmasked portions of the arc tube. In order to form a fine line or coil shape, a conductive powder is mixed with an alcohol/cellulose carrier and applied to the substrate with an ink dispenser through a pen tip. It is possible to blend the conductive powder with other materials, e.g., alumina, in order to improve the translucency, adherence, or electrical properties of the integral susceptor. After the coating of conductive material is applied, the prefired arc tube is then sintered, e.g., at 1880° C. for 1 hour in a flowing $N_2$/8% $H_2$ gas atmosphere. The conductive material in the coating sinters simultaneously onto the ceramic arc tube. In an alternative method, the conductive coating is applied using a vapor deposition technique, e.g., sputtering or plasma vapor deposition, after the arc tube has been fully sintered.

As stated previously, the conductive susceptor material should have a coefficient of thermal expansion similar to that of the arc tube material, be able operate at high temperatures (~1900° C.) in inert atmospheres, and couple well with the applied RF energy. Preferred conductive materials include titanium nitride, zirconium nitride, carbon, tungsten, niobium, molybdenum, cermets, or combinations thereof. The properties of some of these materials are listed in Table 1. More preferably, the integral susceptor is comprised of titanium nitride or a tungsten/alumina cermet. The thickness of the susceptor coating ranges from about 15 to about 100 μm. For example, the preferred thickness of a tungsten/alumina cermet stripe is 17 to 37 μm. This yields a suitable electrical performance while providing thermal expansion compatibility with a polycrystalline alumina (PCA) substrate. For TiN coatings on PCA, the preferred thickness is from 20 to 100 μm in order to produce a surface resistivity of 0.9 to 1.3 ohms across a distance of 2 mm.

be used for sealing other arc tube configurations and types, in particular, e.g., high pressure sodium arc tubes.

The arc tube 1 is a two-piece design which is made by joining two identically molded ceramic halves in their green state. The method of joining the arc tube halves typically leaves a cosmetic seam 5 in the center of the arc tube where the halves were mated. A more detailed description of a method of making this type of ceramic arc tube is described in U.S. Pat. No. 6,620,272 which is incorporated herein by reference. The ceramic arc tube material is a translucent polycrystalline alumina (PCA), although other ceramic materials may be used. The arc tube has an axially symmetric body 6 which encloses a discharge chamber 12. Two opposed capillary tubes 2 extend outwardly from the body 6 along a central axis. In this 2-piece design, the capillary tubes have been integrally molded with the arc tube body. The discharge chamber 12 of the arc tube contains a buffer gas, e.g., 30 to 300 torr Xe or Ar, and a metal halide fill 8, typically a mixture of mercury and metal halide salts, e.g., TlI, NaI, $DyI_3$, $HoI_3$, $TmI_3$, and $CaI_2$.

Figure 2:
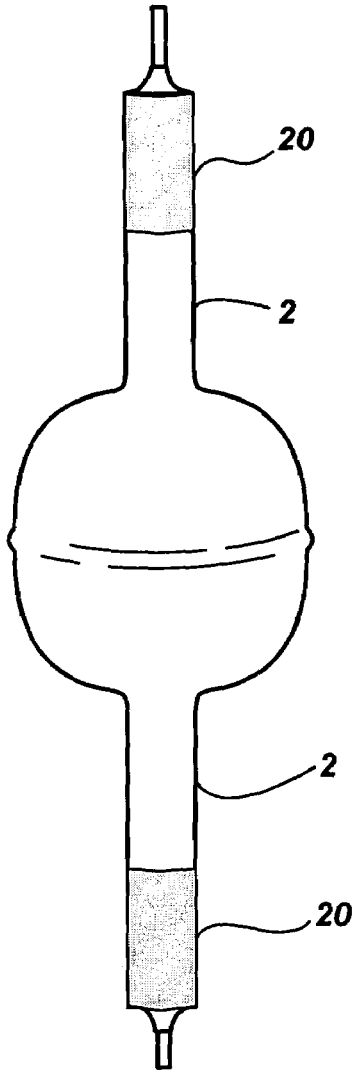
FIG. 2 is a front view of the sealed arc tube of FIG. 1 further illustrating the band structure of the integral susceptors.

Electrode assemblies 14 are inserted into each capillary tube 2. One end of the electrode assembly 14 protrudes out of the arc tube to provide an electrical connection. The tips of the electrode assemblies extend into the hemispherical end wells 17*a*, 17*b* of the discharge chamber and are fitted with a tungsten coil 3 or other similar means for providing a point of attachment for the arc discharge. The electrode assemblies are sealed hermetically to the capillary tubes by a frit material 9 (preferably, a $Al_2O_3$-$SiO_2$-$Dy_2O_3$ frit). Integral susceptors 20 are disposed on the exterior surface of capillary tubes 2 in the seal regions 25. In this first alternate embodiment, the integral susceptors 20 were applied as a uniform coating forming a band around the end of the capillary. The band structure is more clearly illustrated in FIG. 2. Because the edge of the susceptor creates a significant temperature gradient at the edge of the seal region, the longitudinal extent of the integral susceptor acts to determine the length of each seal by controlling the penetration of the molten frit into the capillary.

TABLE 1

| Material | Linear Expansion Coefficient ($\times 10^{-6}$/° C.) 25° C. | 325° C. | 1125° C. | Thermal Conductivity (W/cm-K) | Electrical Resistivity at ~25° C. (μΩ-cm) | Melting Point (° C.) | Max. Operating Temp. in Inert Gas (° C.) | Color |
|---|---|---|---|---|---|---|---|---|
| PCA | 5.4 | 7.9 | 10.1 | 0.35 | $1 \times 10^{22}$ | 2050 | 1900 | — |
| TiN | 6.4 | 8.6 | 10.5 | 0.29 | 22 | 2930 | 1900 | gold |
| ZrN | 5.8 | 7.3 | 9.1 | — | 13.6 | 2980 | — | gold |
| W | 4.5 | 4.7 | 5.4 | 1.73 | 5.65 (37 @1100 K) | 3410 | — | black |
| Graphite | 4.5–8.0 | | | 0.06–19.6 | 1375 | 3550 | 2000–3500 | black |
| Mo | 5.0 | — | — | ~1.38 | 5.3 | 2617 | — | black |
| Nb | 7.0 | — | — | 0.54 | 12.5 | 2468 | — | black |

Figure 3:
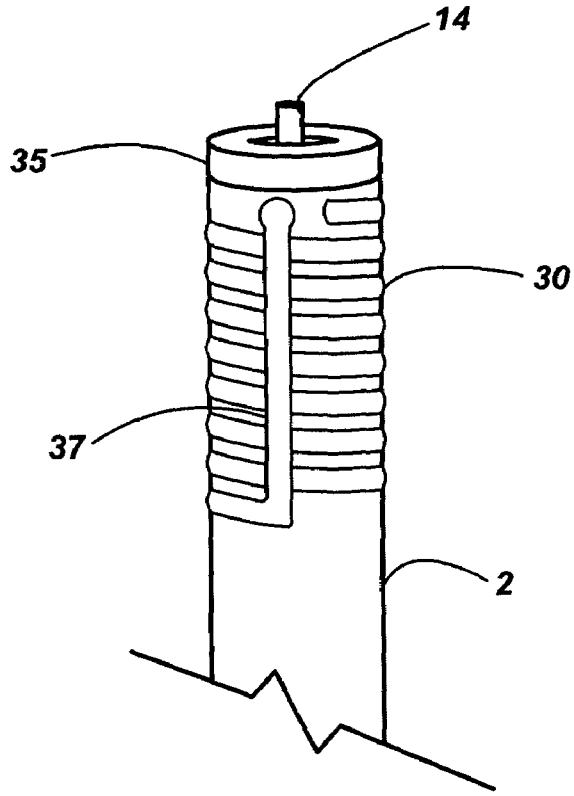
FIG. 3 is a partial view of a capillary tube of a ceramic arc tube prior to sealing wherein the integral susceptor has as a coil structure.
Figure 4:
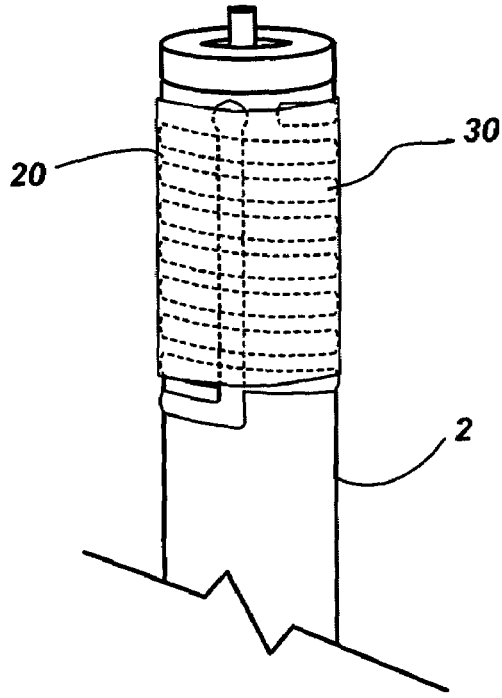
FIG. 4 is a partial view of a capillary tube of a ceramic arc tube prior to sealing wherein the integral susceptor has a combined coil and band structure.

FIG. 1 is a cross-sectional illustration of a sealed ceramic metal halide arc tube having integral susceptors according to this invention. The basic shape of arc tube shown here is generally referred to as a "bulgy" shape. The bulgy shape is preferred because it provides a more uniform temperature distribution compared to right-cylinder shapes such as those described in U.S. Pat. Nos. 5,424,609 and 6,525,476. However, as one skilled in the manufacture of ceramic arc tubes will recognize, the integral susceptor of this invention may In the sealing operation, a ring 35 of the frit material is placed over the protruding end of the electrode assembly as illustrated in FIGS. 3 and 4. This end of the capillary is then inserted into an RF induction coil under an inert atmosphere at a controlled pressure. The RF coil is powered using an RF frequency that couples well with the integral susceptor. The RF energy rapidly heats the end of the capillary tube until the frit ring melts. A combination of capillary action and gravity draws the molten frit into the end of the capillary tube and along the electrode assembly. The molten frit solidifies when it encounters the temperature gradient at the edge of the susceptor thereby fixing the penetration length of the frit. The RF power is then turned off completing the seal. The lamp fill (Hg and metal halide salts) is then inserted into the arc tube through the open capillary and a second electrode assembly and frit ring placed in position. The sealing process is then repeated to completely seal the arc tube.

Figure 5:
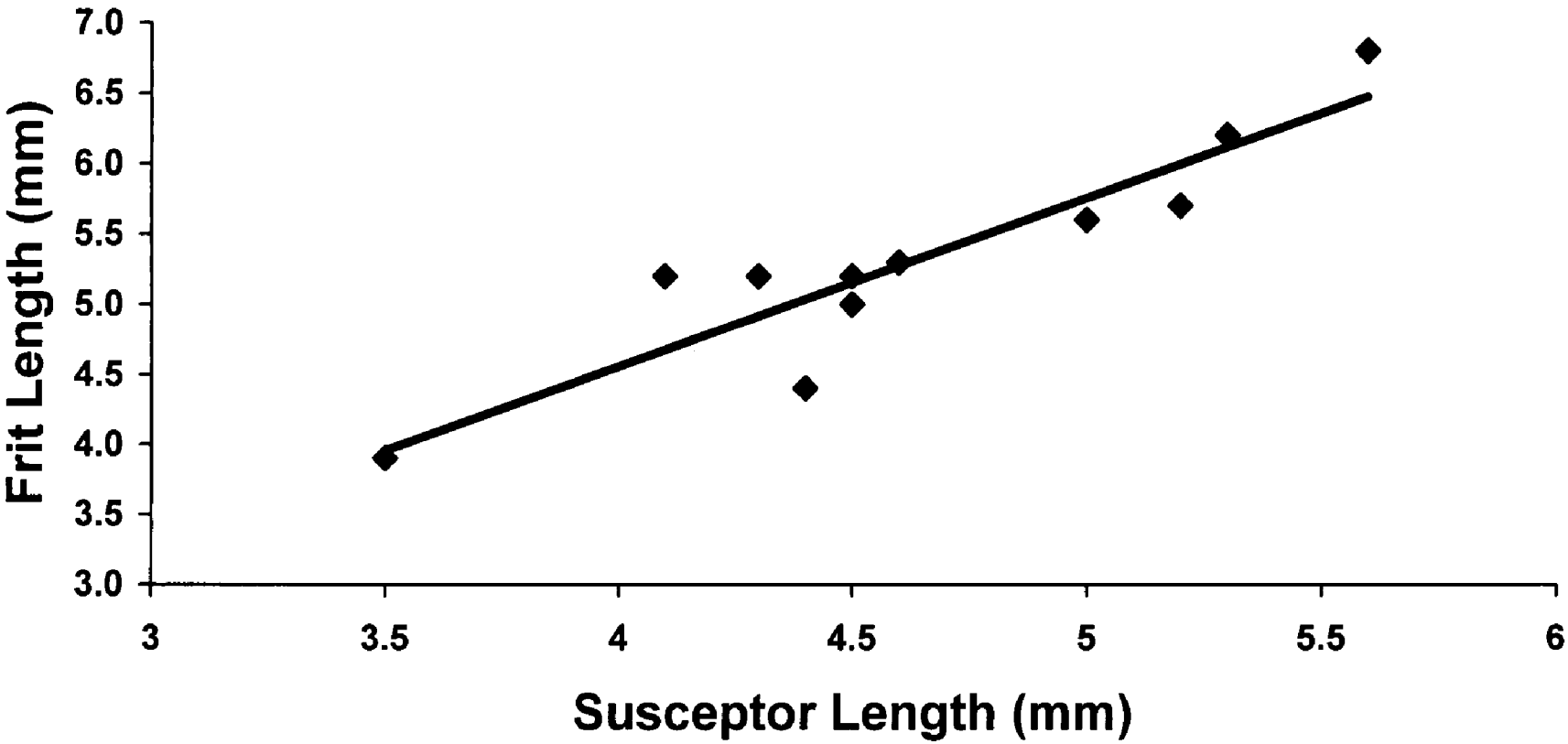
FIG. 5 is a graph illustrating the relationship between the susceptor length and the length of the frit seal.

The linear relationship between the susceptor length and the length of the frit seal is shown in FIG. 5. The use of the integral susceptor allows for a more accurate placement of the frit seal and minimizes unwanted migration of the frit beyond the seal region. This is especially important in ceramic metal halide lamps where the frit material is susceptible to attack by the corrosive metal halide salts in the arc tube fill.

FIG. 3 shows a partial view of a capillary tube of a ceramic arc tube prior to sealing. A ring 35 of frit material is shown placed over the protruding end of the electrode assembly 14. According to a second alternate embodiment, the integral susceptor 30 has a coil structure. A longitudinal stripe 37 completes the electrical circuit between the ends of the coil to enable RF heating. It is not necessary that the longitudinal stripe connect to each turn of the coil. Furthermore, means other than a longitudinal stripe could be used to make the electrical connection between the ends of the coil structure. The coil structure has the added advantage of creating a partial window through which the frit flow into the capillary may be monitored during sealing.

FIG. 4 also shows a partial view of a capillary tube prior to sealing. A third alternate embodiment of the integral susceptor is shown wherein the integral susceptor is a combination of the coil and band structures. In particular, the coil structure 30 of FIG. 3 has been covered with the band structure 20 of FIGS. 1 and 2. The combined structure can be used to induce a very intense heating in the band region along with a decreasing gradient in the coil region. This can help reduce the thermal stresses which are induced in the ceramic substrate, particularly in ceramic pieces which have a large thermal mass.

While there has been shown and described what are at the present considered the preferred embodiments of the invention, it will be obvious to those skilled in the art that various changes and modifications may be made therein without departing from the scope of the invention as defined by the appended claims.

We claim:

1. A ceramic arc tube including a seal region having an integral susceptor comprised of a conductive material.

2. The ceramic arc tube of claim 1 wherein the integral susceptor has a band structure.

3. The ceramic arc tube of claim 1 wherein the integral susceptor has a coil structure.

4. The ceramic arc tube of claim 1 where the integral susceptor has a combined band and coil structure.

5. The ceramic arc tube of claim 3 wherein the integral susceptor has a longitudinal stripe connecting at least the ends of the coil.

6. The ceramic arc tube of claim 1 wherein the conductive material selected from titanium nitride, zirconium nitride, carbon, tungsten, niobium, molybdenum, cermets, or combinations thereof.

7. The ceramic arc tube of claim 1 wherein the integral susceptor is comprised of a layer of conductive material on an exterior surface of the arc tube.

8. The ceramic arc tube of claim 7 wherein the layer of conductive material is sintered to the surface of the ceramic arc tube.

9. The ceramic arc tube of claim 7 wherein the thickness of the layer is from about 15 to about 100 μm.

10. The ceramic arc tube of claim 7 wherein the conductive material is selected from titanium nitride or a mixture of tungsten and alumina.

11. The ceramic are tube of claim 10 wherein the conductive material is titanium nitride and the thickness of the layer is from 20 μm to 100 μm.

12. The ceramic arc tube of claim 10 wherein the conductive material is a mixture of tungsten and alumina and the thickness of the layer is from 17 μm to 37 μm.

13. The ceramic arc tube of claim 11 wherein the surface resistivity of the integral susceptor is from 0.9 to 1.3 ohms across a distance of 2 mm.

14. The ceramic arc tube of claim 1 wherein the conductive material has a coefficient of thermal expansion that is similar to the coefficient of thermal expansion of the ceramic arc tube material.

15. A ceramic arc tube comprising an axially symmetric body enclosing a discharge chamber, two opposed capillary tubes extending outwardly from the body along a central axis, each capillary tube having an electrode assembly and a seal region, each seal region having an integral susceptor comprised of a layer of a conductive material.

16. The ceramic arc tube of claim 15 wherein the integral susceptor has a band structure.

17. The ceramic arc tube of claim 15 wherein the integral susceptor has a coil structure.

18. The ceramic arc tube of claim 15 wherein the integral susceptor has a combined band and coil structure.

19. A method for sealing an electrode assembly in a ceramic arc tube comprising:

(a) forming an arc tube body of a ceramic material, the arc tube body having a capillary tube;

(b) forming an integral susceptor in a seal region of the capillary tube;

(c) inserting an electrode assembly into the capillary tube and placing a frit material adjacent to the seal region;

(d) applying RF energy to the integral susceptor to heat the capillary tube and the frit material whereby the frit material melts and flows into the capillary tube along the electrode assembly; and (f) removing the RF energy to cause the frit material to solidify and form a seal.

20. The method of claim 19 wherein the length of the integral susceptor determines the length of the seal.

* * * * *